US009679422B2

(12) United States Patent
Nicholson

(10) Patent No.: US 9,679,422 B2
(45) Date of Patent: Jun. 13, 2017

(54) METHOD FOR INCREASING ACCURACY OF VEHICLE DATA

(71) Applicant: William D. Nicholson, Waukesha, WI (US)

(72) Inventor: William D. Nicholson, Waukesha, WI (US)

( * ) Notice: Subject to any disclaimer, the term of this patent is extended or adjusted under 35 U.S.C. 154(b) by 0 days.

(21) Appl. No.: 14/806,930

(22) Filed: Jul. 23, 2015

(65) Prior Publication Data

US 2017/0024941 A1 Jan. 26, 2017

Related U.S. Application Data

(60) Provisional application No. 61/999,311, filed on Jul. 23, 2014.

(51) Int. Cl.
*G07C 5/08* (2006.01)

(52) U.S. Cl.
CPC ..... *G07C 5/0808* (2013.01); *G07C 2205/02* (2013.01)

(58) Field of Classification Search
USPC ..... 701/32.5, 99, 54, 34.4; 340/438–439, 340/461, 442, 444; 710/5, 17, 33
See application file for complete search history.

(56) References Cited

U.S. PATENT DOCUMENTS 7,421,321 B2 * 9/2008 Breed ..... B60C 11/24 340/442
8,052,573 B2 * 11/2011 Honma ..... F16D 48/06 477/120
8,058,982 B2 * 11/2011 Crowe ..... B60K 6/48 340/439
9,096,214 B2 * 8/2015 Terakawa ..... F02D 29/02
9,283,954 B2 * 3/2016 Dalum ..... B60W 20/12
9,353,806 B2 * 5/2016 Kim ..... F16D 48/06
9,412,282 B2 * 8/2016 Hunt ..... G09B 19/167
2001/0020789 A1 * 9/2001 Nakashima ..... B60K 6/365 290/40 C
2005/0245351 A1 * 11/2005 Yamada ..... B60W 10/06 477/110
2007/0135988 A1 * 6/2007 Kidston ..... G07C 5/08 701/102

(Continued)

FOREIGN PATENT DOCUMENTS

JP 2004-134516 * 4/2004 ..... B60W 10/06
JP 2007-305464 * 11/2007 ..... F16D 48/06

(Continued)

OTHER PUBLICATIONS

Using verified control envelopes for safe controller design; Nikos Aréchiga; Bruce Krogh; 2014 American Control Conference ; Year: 2014; pp. 2918-2923, DOI: 10.1109/ACC.2014.6859307.*

(Continued)

*Primary Examiner* — Cuong H Nguyen

(57) ABSTRACT

The present invention is for a method of creating new vehicle data using existing vehicle data. The method relies on using vehicle parameter(s) to adjust a less accurate parameter or create a new related parameter for subsequent use. This will be useful in situations where the vehicle network signal provided to a device such as an OBDII data collection system is not accurate or does not have enough resolution.

23 Claims, 7 Drawing Sheets

```
TempChar=MAXGEARS;
if ((SpeedResolution<=3)&&(CurrentSpeed < MAXSPEEDS))
 {
      // Calculate Predicted Speed
      for (TempChar=0;TempChar < MAXGEARS;TempChar++)
      {
      if(SpeedRpmMap[CurrentSpeed].MinRPM[TempChar]==9999)//Speedmap is empty so
save new gear
            {
                  // found an empty gear now fill it
                  TempCalc = CurrentRPM - OldRPM;
                  if (TempCalc < 0)
                  {
                        TempCalc = 0 - TempCalc;
                  }
                  //Make sure its very stable
                  if ((TempCalc <= 26)&&(CurrentSpeed == OldSpeed))
                  {
                        SpeedRpmMap[CurrentSpeed].MinRPM[TempChar] = CurrentRPM;
                        if(SpeedRpmMap[CurrentSpeed].MinRPM[TempChar] !=
0)//Insure that its not a divide by zero
                        {
                              TempCalc = (signed long) (CurrentSpeed * CurrentRPM
* 1000)/ (signed long) SpeedRpmMap[CurrentSpeed].MinRPM[TempChar];
                        }

                        TempChar=MAXGEARS+1;
                  }else
                  {
                        // Dont add a new gear if RPM changing too rapidly.
                        TempChar=MAXGEARS-1;
                  }
            }
```

```
else
      {// Gear not empty so calculate Speed
            if ((signed long) SpeedRpmMap[CurrentSpeed].MinRPM[TempChar] !=0)
            {
                  TempCalc = (signed long) (CurrentSpeed * CurrentRPM *
                  1000)/ (signed long)
                  SpeedRpmMap[CurrentSpeed].MinRPM[TempChar];
            }else
            {
                  TempCalc = 0;
            }
```

(56) References Cited

U.S. PATENT DOCUMENTS

| | | | | |
|---|---|---|---|---|
| 2007/0179017 | A1* | 8/2007 | Yamada | B60W 10/06 477/107 |
| 2010/0052888 | A1* | 3/2010 | Crowe | B60K 6/48 340/461 |
| 2011/0130906 | A1* | 6/2011 | Mayer | G07C 5/008 701/22 |
| 2011/0246010 | A1* | 10/2011 | De La Torre Bueno | B60K 6/46 701/22 |
| 2012/0179341 | A1* | 7/2012 | Hou | B60W 30/1882 701/54 |
| 2012/0197471 | A1* | 8/2012 | Irisawa | B60K 6/445 701/22 |
| 2013/0179007 | A1* | 7/2013 | Dalum | H01M 16/006 701/2 |
| 2013/0304337 | A1* | 11/2013 | Terakawa | F02D 29/02 701/58 |
| 2014/0180557 | A1* | 6/2014 | Hunt | B60T 8/172 701/99 |
| 2016/0110935 | A1* | 4/2016 | Kwak | G07C 5/0808 701/123 |
| 2016/0252381 | A1* | 9/2016 | Kwak | G01F 9/00 701/123 |
| 2017/0024941 | A1* | 1/2017 | Nicholson | G07C 5/0808 |

FOREIGN PATENT DOCUMENTS

| | | | | |
|---|---|---|---|---|
| KR | 440335 B | * | 7/2002 | F16H 61/0437 |
| KR | DE 102014113905 A1 | * | 7/2015 | F16D 4/06 |

OTHER PUBLICATIONS

DrivingStyles: A smartphone application to assess driver behavior; Javier E. Meseguer; Carlos T. Calafate; Juan Carlos Cano; Pietro Manzoni; 2013 IEEE Symposium on Computers and Communications (ISCC); Year: 2013; pp. 000535-000540, DOI: 10.1109/ISCC.2013.6755001.*

An assisted speed-sensorless control of induction motor drives for railways applications; Domenico Perna et al.; 2016 Inter Conf. on Electrical Systems for Aircraft, Railway, Ship Propulsion and Road Vehicles & Inter. Transportation Electrification Conf. (ESARS-ITEC); Year: 2016; pp. 1-7, DOI: 10.1109/ESARS--ITEC.2016.7841440.*

Uncertainty in Bus Arrival Time Predictions: Treating Heteroscedasticity With a Metamodel Approach; Aidan O'Sullivan; Francisco C. Pereira; Jinhua Zhao; Harilaos N. Koutsopoulos; IEEE Transactions on Intelligent Transportation Systems; Year: 2016, vol. 17, Issue: 11; pp. 3286-3296, DOI: 10.1109/TITS.2016.2547184.*

UrbanEye: An outdoor localization system for public transport; Rohit Verma; Aviral Shrivastava; Bivas Mitra; Sujoy Saha; Niloy Ganguly; Subrata Nandi; Sandip Chakraborty; IEEE INFOCOM 2016—The 35th Annual IEEE International Conference on Computer Communications; Year: 2016; pp. 1-9, DOI: 10.1109/INFOCOM.2016.7524393.*

Accurate remaining range estimation for Electric vehicles; Joonki Hong; Sangjun Park; Naehyuck Chang; 2016 21st Asia and South Pacific Design Automation Conference (ASP-DAC) ; Year: 2016; pp. 781-786, DOI: 10.1109/ASPDAC.2016.7428106.*

* cited by examiner

Software for Speed Calculation Embodiment

© CopyRight, 2015, William D Nicholson

```
if( VehicleSpecific.ConnectionStatus != VEHICLECONNECTIONESTABLISHED)
{
      VehicleSpecific.TimeOfLastMileageCalculation = TimeInMilliseconds();
      VehicleCalculated.PredictedVehicleSpeed =0;
      VehicleCalculated.PredictedRPM =0;
      OldSpeed =0;
      OldRPM=0;
      OldPredictedSpeed =0;
      TimeDifference = 0;
}
else
{
      TimeDifference =
CalculateMillisecondsDifference(VehicleSpecific.TimeOfLastMileageCalculation);
}
```

Figure 6

```
if (TimeDifference > 100)
{
      VehicleSpecific.TimeOfLastMileageCalculation = TimeInMilliseconds();
```

Figure 7

```
// Assume that RPM lags behind Wheel speed

CurrentRPM = (unsigned short) PIDData[PIDLocation[0x0C][0]].Value;
CurrentSpeed = (unsigned char) PIDData[PIDLocation[0x0D][0]].Value;
if (CurrentSpeed == 0)
{
      TempFloat = 0;
      VehicleCalculated.PredictedVehicleSpeed = 0;
}
else
{
```

Figure 8

```
TempChar=MAXGEARS;
if ((SpeedResolution<=3)&&(CurrentSpeed < MAXSPEEDS))
 {
      // Calculate Predicted speed
      for (TempChar=0;TempChar < MAXGEARS;TempChar++)
      {
      if(SpeedRpmMap[CurrentSpeed].MinRPM[TempChar]==9999)//Speedmap is empty so
save new gear
            {
                  // Found an empty gear now fill it
                  TempCalc = CurrentRPM - OldRPM;
                  if (TempCalc < 0)
                  {
                        TempCalc = 0 - TempCalc;
                  }
                  //Make sure its very stable
                  if ((TempCalc <= 26)&&(CurrentSpeed == OldSpeed))
                  {
                        SpeedRpmMap[CurrentSpeed].MinRPM[TempChar] = CurrentRPM;
                        if(SpeedRpmMap[CurrentSpeed].MinRPM[TempChar] !=
0)//insure that its not a divide by zero
                        {
                              TempCalc = (signed long) (CurrentSpeed * CurrentRPM
* 1000)/ (signed long) SpeedRpmMap[CurrentSpeed].MinRPM[TempChar];
                        }

                        TempChar=MAXGEARS+1;
                  }else
                  {
                        // Dont add a new gear if RPM changing too rapidly.
                        TempChar=MAXGEARS-1;
                  }
            }
```

Figure 9

```
      else
            {// Gear not empty so calculate Speed
                  if ((signed long) SpeedRpmMap[CurrentSpeed].MinRPM[TempChar] !=0)
                  {
                        TempCalc = (signed long) (CurrentSpeed * CurrentRPM *
                        1000)/ (signed long)
                        SpeedRpmMap[CurrentSpeed].MinRPM[TempChar];
                  }else
                  {
                        TempCalc = 0;
                  }
```

Figure 10

```
// These two checks make sure the calculated value is +- one speed resolution + 1 KM.
                    // If its not the gear must have changed
                    if (TempCalc < ((CurrentSpeed + SpeedResolution + 1) * 1000))
                    {
                          // Speed is lower than the upper limit it should be
                          if (TempCalc > ((CurrentSpeed-SpeedResolution - 1) *
                          1000))
                          {
                                // This is the right gear
                                if (CurrentRPM <
                                      SpeedRpmMap[CurrentSpeed].MinRPM[TempChar])
                                {
                                      TempCalc2 = CurrentRPM - OldRPM;
                                      if (TempCalc2 < 0)
                                      {
                                            TempCalc2 = 0 - TempCalc2;
                                      }

                                      if ((TempCalc2 <= 26)&&(CurrentSpeed ==
                                      OldSpeed))
                                      {
                                // Its very stable and lower so adjust the gear
                                      SpeedRpmMap[CurrentSpeed].MinRPM[TempChar]=
                                      CurrentRPM;
                                      }
                                }

                                TempChar=MAXGEARS+1;
                          }

                    }

            }

      }
 }
```

Figure 11

```
// Gear not found
if (TempChar== MAXGEARS)
{
      TempCalc= (signed long) CurrentSpeed * 1000 + ((signed long) SpeedResolution *
1000) / 2 ;// 1/2 Km/hr
}
```

Figure 12

```
 // Adjust Speed Resolution to the minimum returned from the vehicle
TempChar = (char)(CurrentSpeed - OldSpeed);
if (TempChar < 0 )
{
      TempChar= 0 -TempChar;
}
if (TempChar == 0)
{
      asm{nop;}// Do nothing
}
// Adjust to the minimum resolution the vehicle is returning // Some nissans only
return every 2 km/hr
else if (TempChar <SpeedResolution)
{
      SpeedResolution= TempChar;
}
```

Figure 13

```
VehicleCalculated.PredictedVehicleSpeed = TempCalc;
// VehicleCalculated.PredictedVehicleSpeed = (long)
PIDData[PIDlocation[0x0D][0]].Value * 1000  + (long) SpeedAdjustment ;
TempFloat =  (float) (VehicleCalculated.PredictedVehicleSpeed * TimeDifference) /
(float) 1000.000;
TempFloat = TempFloat / (float) 3600000.000;
// Basic Equation KM = Current KM + KM/Hour * 1Hr/3600 Seconds  * X Seconds
// Kilometers driven this second = TempFloat KM/hr * ms * 1 hr / 3600 seconds * 1 sec
/ 1000 msec
VehicleStats.TotalMileage = VehicleStats.TotalMileage + TempFloat;}// NOTE THE VALUE
OF TempFLOAT is used below
```

Figure 14

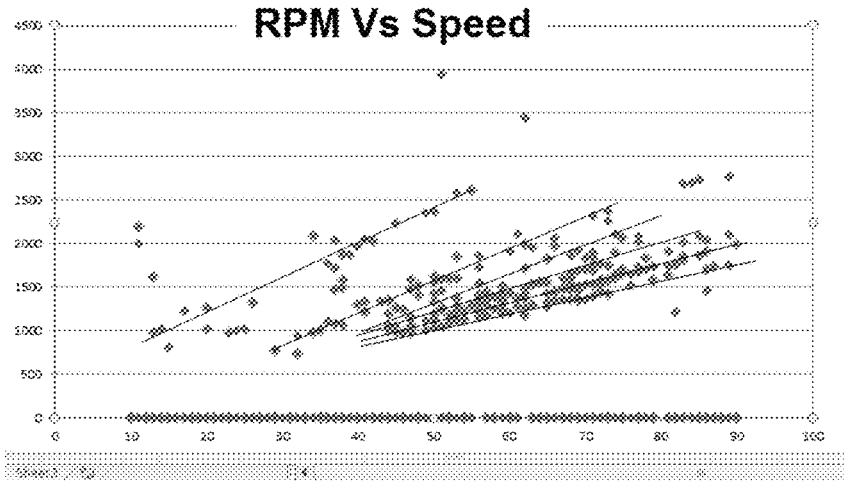

Figure 15

METHOD FOR INCREASING ACCURACY OF VEHICLE DATA

CROSS REFERENCE TO RELATED APPLICATION

This application relates to and claims priority from U.S. Provisional Application Ser. No. 61/999,311 filed on Jul. 23, 2014, which is hereby incorporated by reference in its entirety.

A portion of the disclosure of this patent document contains material which is subject to (copyright or mask work) protection. The (copyright or mask work) owner has no objection to the facsimile reproduction by anyone of the patent document or the patent disclosure, as it appears in the Patent and Trademark Office patent file or records, but otherwise reserves all (copyright or mask work) rights whatsoever.

BACKGROUND OF THE INVENTION

The present invention is in the field where a device collects data from a vehicle and that data is used for various purposes. Data may be used in the device itself or off board the device/vehicle. One common application for such a device is a vehicle data collection device used for Usage Based Insurance (UBI) which connects to a vehicle and calculates or reads vehicle speed, distance driven, deceleration and other vehicle data. In 1996 the US Government required that all new light duty vehicles incorporate a standard called OBDII to communicate emissions related information via a standard connector and a standard set of communications protocols utilizing several different electronic signal levels/networks. This standard has been responsible for a wide proliferation of products related to vehicle data and collection of data. This standard has been codified into law by the California Air Resources Board which establishes the legal requirements for the car manufacturers to implement cars with the OBDII features.

Many devices of various natures have been designed to read the data from a vehicle's electrical bus or OBDII port and then use that data for a multitude of uses. The accuracy and resolution of the data signals are defined in the OBDII standard. Since all manufacturers must conform to the OBDII standard, the accuracy and resolution requirements for the data limit the accuracy and resolution of the data. The OBDII Standard is defined by law in the California code of Regulations:

"1968.2. Malfunction and Diagnostic System Requirements 2004 and Subsequent Model Year Passenger Cars, Light Duty Trucks, and Medium Duty Vehicles and Engines."

The OBDII standard incorporates five signaling protocols that are permitted with an OBD-II device. Most vehicles implement only one of the protocols. The protocols are SAE J1850 PWM, SAE J1850 VPW, ISO 9141-2, ISO 14230 KWP2000 and ISO 15765 CAN All vehicles manufactured since 2008 are required to use the ISO 15765 CAN protocol of the standard.

All OBD-II equipped vehicles use the same mandated diagnostic connector, but different pins are used for different protocols with the exception of pin 4 (battery ground) and pin 16 (battery positive). Many countries around the world have adopted the same or similar standard such as EOBD used in Europe. Both the US and international standards define the data that is available in various formats. Most device manufacturers, wishing to conform to the standards, purchase the standards directly from the Society of Automotive Engineers (SAE) as each standard is needed. They may also purchase a complete copy of the standard in a book form which is the SAE book: HS-3000. The standards have enabled a wide variety of devices and applications to proliferate.

In addition to the OBDII standard methods for gathering data, most vehicle manufacturers have additional methods they incorporate into a vehicle for returning data from a diagnostic port from a vehicle bus. These methods are often referred to in the industry as proprietary communications. Proprietary communications provide the means to read data that is not available in the OBDII standard. They supply more data about the emissions system and also provide data on non-emissions related systems such as the vehicle body, chassis, airbags etc. In order to use proprietary communications to gather data from the vehicle bus, a device manufacturer must normally sign a license with most vehicle manufacturer(s) (OEM). Once the license is signed, a proprietary data and communication standard will be supplied by the OEM or a $3^{rd}$ party organization such as the Equipment and Tool Institute. This standard then tells a device manufacturer how to gather the proprietary data. Proprietary communications provide a unique challenge to device manufacturers as the methods for reading data are all different depending on the make and sometimes model and year of the vehicle. In addition, proprietary communication commands often have some of the same problems with accuracy and resolution of certain signals as outlined below.

Problem Solved

Signals coming from any vehicle designed to conform to the OBDII standard include vehicle speed, engine RPM and many other signals. In a particular problem area, a vehicle using the OBDII standard is required to make available vehicle data that includes a vehicle speed signal. The OBDII standard does not define a method to retrieve the vehicle's odometer reading so this forces many devices to calculate a distance driven from the vehicle speed signal. To calculate a distance driven, it is necessary to use an integration process and sum the vehicle speed over a period of time or incremental periods of time. The SAE J1979 specification defines the requests, responses, and formats for the OBDII data available from a vehicle. Prior old technology and applications have outlined the integration method to use vehicle speed and time to calculate miles driven. In the case of standard OBDII communications, vehicle speed used in these calculations is vehicle speed returned by the SAE J1979 service one—PID 0x0d vehicle speed command. The SAE J1979 defines the requests, responses, and formats for the OBDII data available from a vehicle.

Current devices and methods used throughout the industry use the vehicle speed and calculate a vehicle distance driven from the speed. This method results in a high degree of inaccuracy because it relies on the basic OBDII vehicle speed command to return an accurate number for speed. The OBDII SAE J1979 (and ISO equivalent (s)) specification defines the requirements for how a vehicle returns the vehicle speed value using the vehicle speed command. The vehicle speed is returned in one byte where each bit represents 1 Km/hr. Using one byte provides a possible range 0-255 Km/hr for the signal. Because of the coarse resolution of 1 Km/hr, any device or calculation that uses the vehicle speed automatically incorporates a high degree of inaccuracy. Consider a vehicle that is traveling at 10.00 km/hr. At 10.00 Km/hr, any device using the OBDII vehicle speed data obtained from the vehicle will see the vehicle is traveling at 10 Km/hr. Using 10 Km/hr as returned by the OBDII command is correct as that is the actual vehicle speed the vehicle is traveling and resulting calculations yield accurate results. Now consider a vehicle operating at 10.99 km/hr. Because of the resolution of the OBDII signal returned by the vehicle using the OBDII speed command, any device or calculation using the OBDII vehicle speed will still wind up using 10 Km/hr for the resulting calculation. Because any calculation is using a vehicle speed that deviates by 0.99 Km/hr, there is an approximate error of 10% (0.99/10) when the vehicle is traveling at 10.99 Km/hr. When confronted with this problem, an engineer would simply increase the resolution of the returned signal by returning vehicle speed with 2 bytes. In many cases such as this one, an engineer getting data from a vehicle does not have access or authority to change the vehicles operating code and must use the data as defined by the OBDII standard or the proprietary commands.

The distance calculated and vehicle speed calculated can be used for many purposes such as mileage, trip lengths, acceleration, de-acceleration, etc. UBI and virtually any other usage for mileage. UBI bases driving discounts based on distance driven, time of day driven, fast starts and fast stops, etc. With errors introduced by using a vehicle speed that could be off by as much as 10-20 percent at slow vehicle speeds, drivers could be unnecessarily penalized. The error is further exasperated by vehicles whose speed signal resolution of the data from the vehicle speed command is coarser than 1 Km/hr. The problem proliferates throughout many vehicle calculations. For example, speed is often used to calculate mileage which is then used to calculate fuel consumption or MPG.

This invention solves this problem by utilizing the much better resolution of the engine RPM signal to calculate a new or adjust the speed signal which results in a speed signal with much more resolution and accuracy. All prior art and current technology utilize the data as it comes from the vehicle. Depending on the device, the data or signals such as speed may be averaged or filtered but this does little or nothing to improve the overall accuracy because the original data coming from the vehicle is defective.

The problem observed and documented is common to many parameters returned from a vehicle using both the OBDII standard and the proprietary standard. One exemplary embodiment below uses the engine RPM and transmission relationship to calculate a better speed but this concept may be extended to other signals. In addition to improving the speed signal, using the methods in this invention may be used to solve similar problems in other embodiments. For example, the current OBDII standard now requires that a vehicle return parameter(s) such as distance driven while the check engine light is on or distance driven since the check engine is cleared. Each of these parameters is defined in the OBDII standard to have 1 Km of resolution. Because vehicle odometer is not available in the OBDII standard, these signals may be used in place of the odometer signal. Using these values for short distance calculations may result in large errors. In order to calculate distance driven, a starting point and an ending point is needed. A net trip mileage would be obtained by subtracting the starting point from the ending point. In a 5 Km trip, the error introduced by the poor resolution of this signal can be as high as 20%.

SUMMARY OF THE INVENTION

The present invention is for a method of creating new vehicle data using existing vehicle data. The method relies on using a signal or signals, to compensate one signal or create a new signal using the data or values from a relationship between signals. An exemplary embodiment of the method for creating vehicle data is based on the fundamental relationship between the Engine RPM signal and the Vehicle speed through a modern vehicle transmission. In a modern transmission, the engine rpm and vehicle speed are directly proportional after accounting for the current transmission gear and the axle ratio of the vehicle. While there is some slip involved in a modern transmission due to transmission fluid, the error introduced by slip may be accounted for using the exemplary embodiment. As defined by the OBDII standard, engine RPM is a very high resolution signal and once the software of the exemplary embodiment maps the transmission, the engine RPM is used to generate a better resolution for the low resolution speed signal. This vehicle speed may then be used in any way to improve the accuracy of existing or new calculations that use vehicle speed and related parameters. In the exemplary embodiment, this is called predicted vehicle speed. This concept may not be limited to the transmission gear ratio relationship. Engine RPM is also related to many other vehicle signals such as MAP or MAF and may be used to create many different new or more accurate signals. The method can be used on a similar signal like transmission speed, wheel speed, etc. This method differs from simply performing calculations to get a parameter that is unavailable as it uses a parameter with better accuracy to improve a calculation. Other embodiments may not use engine RPM but may instead rely on other relationships between data to adjust or calculate a new value for the poor signal.

DESCRIPTION OF THE DRAWINGS

FIG. 6 begins the computer software used to implement a preferred embodiment. This section determines what to do if the vehicle is not running.

FIG. 7 determines if the calculations should be performed.

FIG. 8 obtains the current speed and current RPM signals from a vehicle.

FIG. 9 begins to loop through the RPM speed map and determines if the map has an empty spot for this speed.

FIG. 10 calculates the actual speed predicted using the ratio if the amp for this speed is not empty.

FIG. 11 determines if the actual speed calculated is close enough to be used than the rpm speed map might be updated.

FIG. 12 is the backup speed calculation.

FIG. 13 updates the speed resolution.

FIG. 14 uses the corrected speed in a mileage calculation.

FIG. 15 is a graph of the points in an RPM speed map of a vehicle.

DETAILED DESCRIPTION OF THE INVENTION

The calculations used in this exemplary embodiment of the method are designed to take advantage of the relationship between engine RPM and Vehicle speed in a modern transmission. When a vehicle is operating and in gear, there is a direct proportional relationship between engine RPM and wheel (vehicle) speed. The proportion between the two is affected by the drive shaft, gear box, slip and tire size. If all of the ratios are known and the current gear the vehicle is operating in is known, the vehicle speed can be calculated or estimated directly from the Engine RPM. The vehicle speed signal returned by an OBDII equipped vehicle cannot have a resolution better than 1 Km/hr and some vehicles are known to have an OBDII speed resolution of 2 Km/hr or possibly more. These coarse resolutions produce error in all calculations that use speed, distance driven, acceleration, fuel efficiency, etc.

The engine RPM value supplied by an OBDII equipped light duty vehicle is supplied at a much higher resolution than the OBDII RPM and thus this resolution can be used to calculate a better vehicle speed. This embodiment automatically determines the gear the vehicle is operating in and the ratios between engine RPM and vehicle speed.

Figure 1:
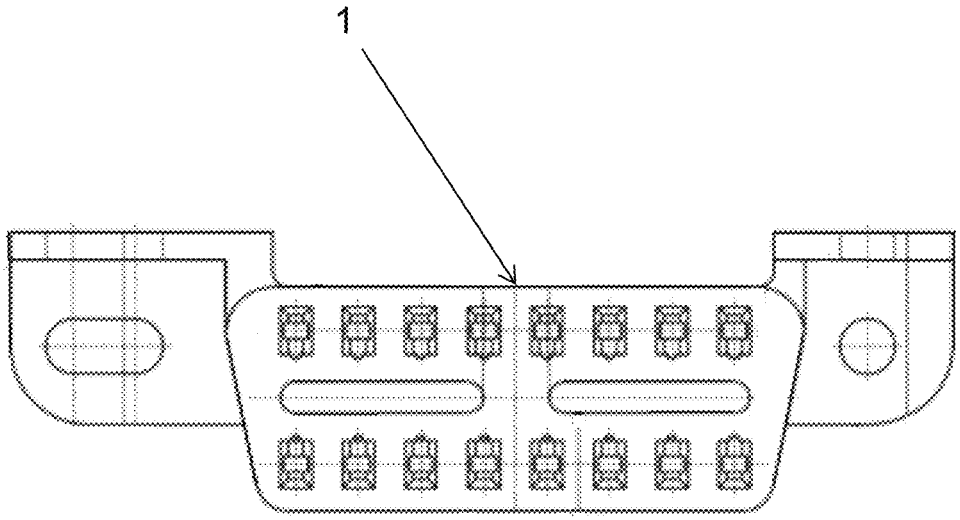
FIG. 1 shows a view of a Vehicle OBD port as defined in the OBDII standard.

A typical OBDII connecter from a car is shown in FIG. 1-1. All light duty vehicles manufactured in the USA are required to have such a connector and common protocols.

Figure 2:
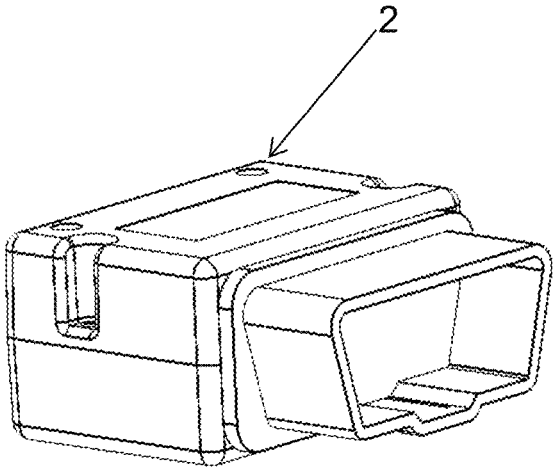
FIG. 2 shows a view of a Generic OBDII device for obtaining vehicle data.

FIG. 2-2 shows a typical OBDII diagnostic device such as those used in UBI insurance programs. This device typically plugs into the connector shown in FIG. 1-1 and stays in the car. Embodiments of this method in this patent may be used with virtually any type of OBDII device or any other type of device that gathers vehicle data.

Figure 3:
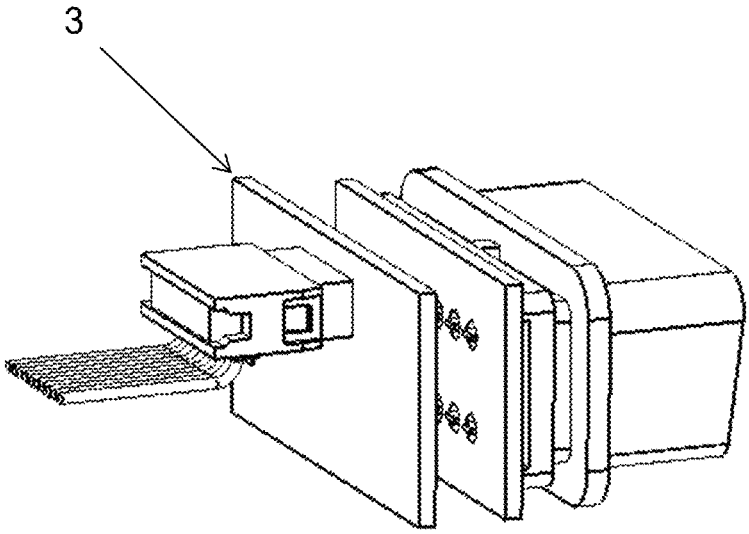
FIG. 3 shows a view of the microcontroller board which is used to implement the method of improving a signal using a relationship.

The device is shown in more detail in FIG. 3 which shows the inside of the device. In this device, FIG. 3-3 points to a microcontroller board which is typical of common devices. This microcontroller controls the device timing memory communications and performs the calculations. In this embodiment of the method, this device is programmed using the C programming language. Embodiments may implement a method utilizing any programming language or any other method of conducting calculations.

Figure 4:
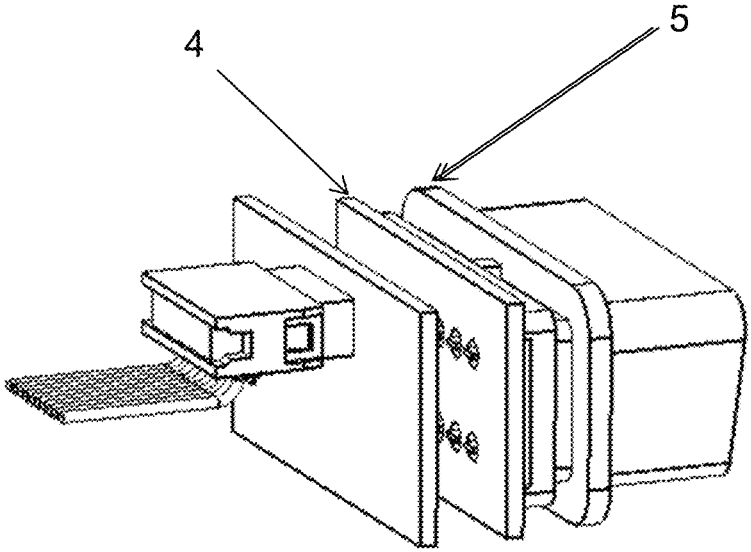
FIG. 4 shows a view of the connector and signal board which is used to connect to the vehicle bus to implement the method of improving a signal using a relationship.
Figure 5:
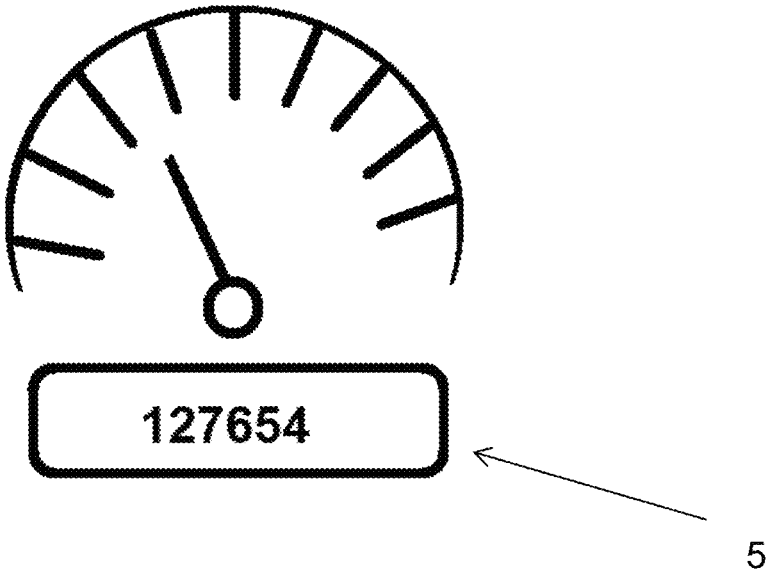
FIG. 5 shows a typical odometer resolution representing the OBDII signal resolution problem.

FIGS. 4-4 and 4-5 show the device connector board and connector which shows how the embodiment connects to the vehicle bus and obtains data. Embodiments may obtain the vehicle utilizing a direct connection, a wireless connection or other method of gathering vehicle data.

FIG. 5 shows a typical vehicle odometer which illustrates the problem. Many if not most odometers and as well signals which represent speed, mileage etc. used around the country often do not have available a tenths digit. This also often applies to the vehicle bus data made available to any other source. Speed or distance used introduces great errors which are compounded more when looking at slow speeds and short distances.

FIG. 6 begins the source code listing of an exemplary embodiment that utilizes the methods of this invention. This embodiment creates a map of speeds from 0 to 100 Km/hr. At each speed, an RPM speed map has a series of minimum RPM values where each RPM represents a gear of the vehicle. As the vehicle is driven, the map fills in with up to 8 different RPMs for a particular speed. Essentially this embodiment maps the transmission gears and for most entries in the RPM speed map, actual gears may be derived by dividing the 8 different engine RPMs from the map for each speed. To calculate the actual gear, one must also take into account the gear box and drive shaft.

An embodiment may be able to use a known set of gears and ratios for a vehicle that is saved in advance from a database or another similar vehicle/transmission. An embodiment may also request the current gear or gear ratio from the vehicle data stream. Over a period of time, as the vehicle is operated, the embodiment learns each gear by examining the RPM values received from the vehicle at any particular vehicle speed. It then saves the minimum RPM received at up to 8 or more particular speed(s). Other vehicle parameters may be created or refined using this method. Other exemplary embodiments may find an rpm using a minimum or maximum value or at another speed point. Embodiments may seek to find the cross over points where a signal crosses from one resolution value to the next value.

There are many different devices that may incorporate the method of enhancing the accuracy of parameters. These calculations may be done on board a vehicle with a device which is intended to stay in the vehicle or with a device that is not designed to stay in a vehicle such as a cell phone or PC or other data. An embodiment may not even calculate a distance driven at all but may simply calculate the vehicle speed to be used later or to adjust other parameters. Further an embodiment may apply a different relationship other than transmission to improve a less accurate signal for better calculations.

In this embodiment, the device in FIG. 2-2 is designed to continually stay in the vehicle attached directly to the OBDII diagnostic port. During normal operation the device begins communicating to the vehicle and begins acquiring vehicle speed and RPM at regular intervals. These parameters are used to implement the calculation of a new vehicle speed that is used throughout the device. The new speed may also used to calculate distance driven.

FIG. 6 shows the software listing of the exemplary embodiment of the method used to predict vehicle speed and then use the speed to calculate distance driven. The software utilizes the method in this embodiment and is saved in the device microprocessor and memory. Other software resides in the device but all of this software is not necessary to implement an embodiment of the method. This software implements all functions and communications necessary to gather data from the vehicle bus. Most important of these functions is to handle the OBDII communications and up to 5 OBDII protocols including:

SAE J1850 PWM
SAE J1850 VPW
ISO 9141-2
ISO 14230 KWP2000
ISO 15765 CAN

FIG. 6 shows the beginning of the implementation of the distance driven calculation. This calculation is run periodically in the software as data is made available from the OBDII bus.

In the background, the device gathers Engine RPM and Vehicle speed periodically so that they are continually current for use by the various processes. When a specified period of time has elapsed and the values for RPM and Vehicle speed are current, the software shown in FIG. 6 begins to operate.

In this embodiment, the software used is RAM intensive to minimize the amount of time it takes to operate the calculations. In RAM, a table of speeds is stored covering Vehicle speeds of 0 to 100 km/hr. This table (called RPM speed map) has 100 rows each representative of a particular speed. There are 8 columns with each corresponding to the engine RPM associated with that row's speed. Each one of the 8 rows represents a gear ratio. FIG. 15 shows a graph of a Speed RPM map that is beginning to fill in as the software learns each new point. The trend lines show the obvious gears and their very good linear relationship on a vehicle that is just in the process of learning the relationship between the gears at all speeds. Once the gears are learned, this relationship enables the fundamental calculation using the liner relationships learned:

Predicted speed=Original Vehicle Speed*Engine RPM

Various embodiments may utilize the calculation in various ways. A new speed may be calculated or the ratio of engine rpm to speed or speed to engine rpm may be used instead of a new speed. Essentially this learned ratio is now the gear ratio.

In FIG. 6, the software handles the calculations for if the vehicle is not running. If the vehicle is not running there is no sense in performing the calculation.

The software in FIG. 7 continues on from FIG. 6 as does each successive figure for the software listing. FIG. 6 through FIG. 14 represents one complete listing of the code for the function to implement this embodiment. The code in FIG. 7 makes sure enough time has elapsed before running the calculation.

The software in FIG. 8 gets the Vehicle speed and RPM signals form the main data cache. If the current speed is zero then the predicted speed is set right away to zero.

The software in FIG. 9 first checks the speed resolutions to see if it is less than 3. Under normal conditions the OBDII speed resolution is 1 KM/hr. Some observed vehicles return a speed resolution of 2 Km/hr or more. The method learns the speed resolution as shown in the code of FIG. 13. The code in FIG. 9 does not begin to execute until the speed resolution is obtained. The need for learning, using and calculating a speed resolution is not readily apparent to a person of skill in the field. Using increases the accuracy of both the main calculations and a fail-safe calculation. The fail safe calculation is operated any time a gear is not found.

The next step in FIG. 9 is the "for" loop which loops through all of the entries in the speed RPM map for the current speed until either a gear (RPM) is found or an empty gear spot is found. The remaining code in FIG. 9 handles the case if the loop reaches the point where the MAP has an empty spot for a new gear (RPM). The software here first subtracts the current RPM from the new RPM value. This is to assure stability of the RPM signal. In addition to checking the stability of the RPM signal it also checks to make sure the speed hasn't changed from the previous point. This enables the software to learn the different RPM values for the same speed. This is essentially the fundamental building block of the algorithm. Assuming the gear and speed of the vehicle stays the same, the engine RPM will vary as the speed increases. For example a car might return 2000 RPM for a speed of 25.00 Km/hr. At 25.99 Km per hour the RPM might be 2100 RPM. If the software learns the lowest point, Speed=25.00 Km/hr and RPM=2000 then when the RPM is 2100 the linear relationship (or any other relationship in other embodiments) may be used to calculate the speed more accurately. Because the vehicle returns 25 Km/hr for 25.00 Km/hr and 25 Km/hr for 25.99 Km/hr in the OBDII data stream, this calculation can now be used to improve the speed. Using this relationship to improve vehicle speed is not readily apparent. Another exemplary embodiment could consider a situation such as in prior art where a MAF sensor is used to calculate fuel consumption. These situations rely on the value of the MAF sensor to be accurate. Older implementations add fuel trim to account for other sources of additional air. In most vehicles, air flow is proportional to RPM or engine load. In an embodiment, if RPM or load is more accurate or has more resolution, these signals can be used to improve the MAF signal first and then use the improved MAF signal for subsequent calculations.

FIG. 10 is the middle of the for loop for all gears. In FIG. 10, a gear is found in the location currently being searched in the RPM speed map. If a gear is found, the fundamental ratio and equation as noted before in this write-up is used to calculate a new speed. This calculation is not readily apparent to someone skilled in the trade.

The code in FIG. 11 completes the for loop and compares the calculated speed to make sure it fits within a speed window around the current speed. (CurrentSpeed+SpeedResolution+1, CurrentSpeed+SpeedResolution−1) This enables two things. First, it prevents the software from using RPM data when the vehicle is rapidly shifting gears which would throw off the accuracy. Next, it enables the software to learn the low point for each speed. The goal of this section is to find the point where the vehicle returned an accurate speed and RPM. For example, the point where the vehicle returns the speed of 25 Km/hr and the speed is actually 25.00 Km/hr. The value of RPM at 25.00 Km/hr is the point that should then be used for the linear relationship between speed and RPM. The code of FIG. 11 also makes sure that the RPM is stable and the speed is not changing before deciding if this is the lowest RPM point for a speed. If the calculation of the speed does not fall within a window of speed resolution, it is assumed in the code that this is not the right gear. Other poorer embodiments might use the speed when it transitions from one value to the value above or below it that differs by one resolution.

FIG. 12 shows the code for the fail safe calculation for when a gear is not found at all. In the fail safe calculation, the speed resolution is used. While not readily apparent to a person of skill in the field, the point halfway between the current speed and the next speed based on the speed resolution is used. Existing calculations used by devices in the present industry know to this inventor all use vehicle speed as returned by the OBDII command to calculate mileage. The fail safe calculation for speed is then:

Predicted Speed=Current Speed+(Speed Resolution/2)

Once the fail safe predicted speed is calculated, the distance driven is calculated for this period of time. Utilizing a point halfway between two speeds reduces the error. Other embodiments may not use the in-between speed but may go right to calculating distance driven. In this case the formula becomes Distance driven=(Current Speed+(Speed Resolution/2))*1 hour/3600 Seconds*Time in seconds.

The code in FIG. 13 is used to calculate the minimum speed resolution for this car. This is continually monitored and updated.

Finally, in FIG. 14, the predicted speed can now be accurately used to calculate a distance driven.

While the main algorithms may not be the same, the methods of the claims may be used in other embodiments to improve vehicle data in general. Various embodiments might use various terms to represent the vehicle data. Each piece of data coming from a vehicle might be considered a parameter or element or in the OBDII terms a PID. The problem solved might also be described as a resolutions problem or also described as an accuracy problem. The concept is still the same when one parameter yields poor results because of inaccuracy or poor resolution.

After driving for a prolonged period of time, the speed map essentially becomes a map of the transmission and gear shift values and may be used for diagnostic purposes.

There are many uses for improved accuracy of signals. By utilizing a higher accurate speed, this embodiment was used to calculate the ratio of vehicle speed as measured by the OBD device to the speed as measured by GPS or another source. Once this relations ship is calculated, Tire pressure and wear can be predicted based on this ratio.

Source Code for an Exemplary Embodiment of the Method

Source code for an exemplary embodiment of the mileage calculation using the transmission relationship between engine RPM and wheel speed is included in the drawings in FIGS. 6 through 14.

The invention claimed is:

1. A method of accurately calculating one or more new vehicle parameters using a vehicle parameter obtained from a vehicle bus for vehicle and driving evaluation comprising:

a. obtaining vehicle speed from a J1708, J1939, OBD, OBDII, OBDIII or CAN vehicle bus using a device communicating with the bus;

b. obtaining an engine RPM from said vehicle bus with said device;

c. developing and using one or more equations where the equations incorporate vehicle speed and engine RPM wherein said equation(s) resolve the value of a vehicle speed using an engine RPM;

d. using said equations with said device to calculate a new resolved vehicle speed and its derivative(s);

e. providing functionality to make the resolved value of the vehicle speed and/or its derivative(s) operationally available through said device.

2. A method of accurately calculating one or more new vehicle parameters using a vehicle parameter obtained from a vehicle bus for vehicle and driving evaluation comprising:

a. using a device operably connected to a J1708, J1939, OBD, OBDII, OBDIII or CAN vehicle bus to obtain one or more reading(s) of a parameter from said vehicle bus;

b. using said device to obtain one or more reading(s) of other parameter(s) from the said vehicle bus;

c. developing and using one or more equations which incorporate said parameters wherein said equation(s) resolve the value of the first parameter using the other parameter(s) obtained;

d. using said equations with said device to calculate a resolved value for the first parameter and/or its derivative(s);

e. providing functionality to make the resolved value of the first parameter and/or its derivative(s) operationally available through said device.

3. The method of claim 1 in which the derivative is a distance.

4. The method of claim 1 in which the derivative(s) represent tire pressure or tire wear.

5. The method of claim 1 in which the derivative(s) represent transmission and gear parameters.

6. The method of claim 1 in which the derivative is an acceleration/deceleration.

7. The method of claim 1 in which the derivative(s) represent trip parameter(s).

8. The method of claim 1 in which the derivative(s) represent other vehicle parameters.

9. The method of claim 1 in which the equation uses the halfway point between two successive vehicle speeds to calculate the resolved vehicle speed value.

10. The method of claim 2 where one parameter is speed and one parameter is RPM.

11. The method of claim 1 in which the equation uses the lowest rpm at unresolved vehicle speed values to resolve the vehicle speed.

12. The method of claim 1 in which the equation uses the highest rpm at unresolved vehicle speed values to resolve the vehicle speed.

13. The method of claim 1 in which the equation uses multiple ranges of engine RPM at unresolved vehicle speed values to resolve the vehicle speed.

14. A method of calculating vehicle tire diagnostic information comprising:

a. obtaining a speed from a vehicle bus using a device communicating with the bus and calculating a new vehicle speed/related parameter using engine RPM or another parameter from the bus to obtain a speed resolution finer than its original;

b. obtaining another vehicle speed/related parameter from another source;

c. developing one or more equations incorporating said speeds/parameters to calculate tire diagnostic parameters.

15. The method of claim 1 in which the equation incorporates additional parameters to calculate the resolved vehicle speed.

16. The method of claim 1 in which the equation resolves any speed parameter to finer than 1 Km/hr.

17. The method of claim 1 in which the equation resolves any distance parameter to finer than 1 Km.

18. The method of claim 14 where the equations are developed using speeds at integer values.

19. The method of claim 1 in which the equation is developed from driving.

20. The method of claim 1 in which the equation used is a function defined by the transmission and/or gear box of the vehicle.

21. The method of claim 14 where the calculations yield a result representative of tire pressure, tire size or tire wear.

22. The method of claim 2 in which the derivative(s) are parameters that represent the performance of the transmission of a vehicle.

23. The method of claim 1 in which the equations consist of multiple equations at various vehicle speed values.

* * * * *